United States Patent [19]

Dimier

[11] Patent Number: 4,813,719

[45] Date of Patent: Mar. 21, 1989

[54] EMERGENCY SKI BOOT REMOVAL DEVICE

[75] Inventor: Jean-Pierre Dimier, Rumilly, France

[73] Assignee: Salomon, S.A., Annecy, France

[21] Appl. No.: 122,636

[22] Filed: Nov. 10, 1987

Related U.S. Application Data

[63] Continuation of Ser. No. 817,497, Jan. 9, 1986, abandoned.

[30] Foreign Application Priority Data

Jan. 9, 1985 [FR] France ..... 85 00759

[51] Int. Cl.[4] ..... A63C 9/08

[52] U.S. Cl. ..... 280/618; 280/626

[58] Field of Search ..... 280/611, 623, 626, 631, 280/634, 617, 618

[56] References Cited

U.S. PATENT DOCUMENTS

| | | | |
|---|---|---|---|
| 3,249,365 | 5/1966 | Beyl | 280/626 |
| 3,612,561 | 10/1971 | Marker et al. | 280/626 |
| 3,964,759 | 6/1976 | Salomon | 280/626 |
| 3,970,326 | 7/1976 | Salomon | 280/626 |
| 4,035,001 | 7/1977 | Jungkind | 280/626 |
| 4,140,332 | 2/1979 | Beyl | 280/626 |
| 4,558,884 | 12/1985 | Guitel et al. | 280/620 |

FOREIGN PATENT DOCUMENTS

| | | |
|---|---|---|
| 1478122 | 8/1969 | Fed. Rep. of Germany . |
| 1363895 | 12/1962 | France . |
| 1442429 | 5/1965 | France . |
| 2157686 | 6/1973 | France . |
| 2248680 | 5/1975 | France . |
| 2258876 | 8/1975 | France . |
| 2263796 | 10/1975 | France . |
| 2368973 | 5/1978 | France . |
| 2397851 | 2/1979 | France . |
| 2537444 | 6/1984 | France . |
| 2546072 | 11/1984 | France . |

OTHER PUBLICATIONS

French Certificate of Utility No. 2,248,680; Published May 16, 1975.

*Primary Examiner*—John J. Love
*Assistant Examiner*—Michael Mar
*Attorney, Agent, or Firm*—Sandler & Greenbaum

[57] ABSTRACT

A ski binding adapted to be displaced between a boot retaining and boot releasing position. The binding includes a jaw and two lateral arms pivotally connected at one end to the ski around a first transverse axis and pivotally connected at their other end to the jaw around a second transverse axis passing through a journal. Also provided is an elastic element for biasing the jaw against pivoting around the second transverse axis, and a retractable support. The support supports the jaw, the arms and the journal when the support is in its active position. The support is also retractable to an inactive position in which the jaw, the arms, and the journal are unsupported by the support. When the support is retracted into this inactive position the jaw, the arms, and the journal can be displaced around the first transverse axis to release the boot from the binding without substantial pivoting around the first transverse axis, and therefore without pivoting against the bias of the elastic element. As a result, the boot can be released from the binding without substantial effort when the support is retracted.

48 Claims, 5 Drawing Sheets

EMERGENCY SKI BOOT REMOVAL DEVICE

This application is a continuation, of application Ser. No. 817,497, filed Jan 9, 1986, now abandoned.

BACKGROUND OF THE INVENTION

1. Field of the Invention

The present invention relates to safety bindings for ski boots which are adapted to retain one of the ends of the boot on a ski. More particularly, the present invention relates to the type of binding which allows for the voluntary removal of the boot independent of skiing conditions.

2. Description of Pertinent Information

All bindings manufactured today currently use mechanisms which automatically free the boot from the binding and the ski when forces experienced by the skier exceed a certain safety threshold. However, during skiing, it is often desirable for the skier to voluntarily remove the boot from the binding independent of these above-mentioned safety considerations. This voluntary removal of the boot is desirable, for example to facilitate travel up the slope on a ski lift, or when the skier wishes to stop skiing or has fallen down. Normally, the removing of the boot is performed by pushing or pulling on a release lever or on the jaw or body of the binding. This operation almost always requires a relatively substantial force to be exerted by the skier. Under normal conditions, it is fairly easy for the skier to exert this substantial force. However, there are certain situations in which it is difficult for the skier to exert such a substantial force. These include when the skier is in an advanced state of fatigue, when the skier is inexperienced, or is a child, or when the skier has fallen in deep or powdered snow which has not resulted in the release of the boot from the binding. Under these conditions, the skier must be able to remove the boot without exerting substantial effort. In addition, it is also necessary for the skier to be able to remove the boot from the binding without substantial effort when the skier is in a particularly critical or delicate position and/or when the skier is wounded or has fractured his leg because under these circumstances any movement made by the skier to free himself from the skis must be performed without increasing the pain felt and without inadvertently exerting a force on the broken leg.

Thus, there is a need for a binding which permits manual removal of the boot from the binding without substantial effort by the skier.

SUMMARY OF THE INVENTION

It is an object of the present invention to overcome the disadvantages of the prior art by providing a binding which permits voluntary removal of the boot from the binding without substantial effort by the skier.

The present overcomes the disadvantages of the prior art by providing an apparatus and a binding which permits voluntary removal of the boot very simply and without requiring a substantial effort by the skier or by another, particularly in the case of an emergency and/or when the boot will not be attached to the binding immediately or shortly afterwards. Further, the present invention can be used with those types of bindings comprising a jaw for retaining the boot on the ski, which is pivotally mounted around an axis transverse the ski and which is supported by one end of two lateral arms. The other end of the lateral arms is journalled on the ski around an axis transverse to the ski. Also provided is an elastic mechanism for normally biasing the jaw into a boot retention position. Bindings which have such an elastic mechanism, two lateral arms, and a jaw are described in French Patent Nos. 1,363,895; 2,258,876; 2,263,796; and Certificate of Utility No. 2,248,680, the disclosures of which are hereby incorporated by reference thereto.

According to one embodiment of the present invention, means are provided to limit the pivoting of the jaw and the lateral arms toward the ski when the binding is in its boot retention position. Furthermore, this means can be retracted by the voluntary intervention of the skier to render this means or retention apparatus inactive or overridden so that the boot can be freed from the binding without substantial effort by the skier.

In this embodiment, the invention comprises a safety binding for retaining a boot on a ski. The binding comprises a jaw for retaining the boot and a support means for limiting the displacement of the jaw toward the ski. The support means is at least partially retractable.

In addition, the jaw is pivotally mounted on the ski around an axis transverse to the ski, and the support means limits the pivoting of the jaw toward the ski.

The binding further comprises two lateral arms each having first and second ends. The first end of the lateral arms are pivotally attached to the ski around an axis transverse to the ski and the second ends of the lateral arms are attached to the jaw. Also provided is a base element positioned under the sole of the boot on the ski. The first ends of the two lateral arms can be pivotally attached to this base element.

The jaw can be pivotally attached to the second ends of the lateral arms, and the binding can further comprise means for elastically biasing the jaw into a position in which the jaw retains the boot on the ski, and means for pivotally attaching the jaw to the second end of the lateral arms. The attaching means, the jaw, and the lateral arms together comprise an assembly. In this embodiment, the support means comprises means for normally limiting the pivoting of the assembly towards the ski.

Further, the support means can comprise a support element displaceable with respect to the ski between an active, support position in which the support element supports the assembly and prevents the assembly from pivoting toward the ski, and an inactive retracted position in which the assembly is unsupported by the support element thereby permitting the assembly to pivot toward the ski. As a result, the support comprises means for withdrawing support for the assembly when the support is displaced into its inactive retracted position. When the support is in its inactive position the skier can easily pivot the assembly toward the ski without substantial effort by pushing the jaw downwardly. This permits the skier to disengage the jaw from the shoe without overcoming the bias of the biasing means to any substantial degree because the assembly is primarily pivoted around the journal axis around which the first ends of the lateral arms pivot.

The support element can comprise an upper surface, and the support means can further comprise at least one rod integral with the lateral arms so that one end of the rod contacts the upper surface of the support element. One end of the at least one rod can comprise a roller which contacts the upper surface of the support element. Furthermore, the at least one rod can extend downwardly from the lateral arms to the support element.

The support element can further comprise a ramp positioned at the forward end of the support element for facilitating the displacement of the roller in the direction of the ski when the support element is displaced into its inactive position.

In addition, the jaw is adapted to be positioned in a retention position in which the jaw holds the boot on the ski, and in a non-retention position in which the jaw releases the boot from the ski and in which the jaw permits the boot to be attached to the binding. In this embodiment, the binding further comprises a body comprising the jaw and a tongue. The tongue extends forwardly and generally horizontally when the jaw is in its non-retention position so as to comprise means for pivoting the jaw from the non-retention position to the retention position in response to downward movement of the boot on the tongue.

Furthermore, the assembly is adapted to pivot downwardly toward the ski around the transverse axis around which the first ends of the lateral arms are pivotally attached to the ski in response to retraction of the support member into its inactive retracted position.

The binding can further comprise an abutment for limiting the displacement of the support element beyond the inactive position. Also, the support element can be slidably attached to the ski so as to slide in the direction of the longitudinal axis of the ski. In this embodiment, the support element has an opening therein, and the binding further comprises means for positioning the support element on the ski at the active and inactive positions. This positioning means comprises a base plate attached to the ski, and a ball spring positioned in the opening in the support. The support element is positioned on top of the base plate to slide thereon, and the base plate comprises a top surface having two spaced apart recesses therein. The position of each recess corresponds to a different one of the active and inactive positions of the support element. Furthermore, the bottom end of the ball spring is adapted to engage the recesses in the base plate.

The binding can further comprise means for elastically biasing the support element against displacement between the active and inactive positions.

In an alternative embodiment, the support element can comprise at least one rod pivotally attached to the lateral arms around an axis transverse to the ski and movable with respect to the ski. One end of the rod is adapted to normally contact one of the following: the upper surface of the ski and the upper surface of an element integral with the ski. In this embodiment, the at least one rod is adapted to be displaced with respect to the ski between an active support position in which the at least one rod supports the assembly by the contact between one end of the rod and one of the upper surface of the ski and the upper surface of an element integral with the ski so as to prevent the assembly from pivoting toward the ski, and an inactive retracted position in which the assembly is unsupported by the at least one rod so as to permit the assembly to pivot toward the ski. In the inactive position the at least one rod is positioned out of contact with one of the upper surface of the ski and the upper surface of an element integral with the ski.

The at least one rod can further comprise a roller positioned at one end of the rod for contacting one of the upper surface of the ski and the upper surface of the element integral with the ski. Also, the lateral arms can comprise a first abutment integral therewith, and in this embodiment the at least one rod can comprise a second abutment. The first and second abutments are adapted to contact each other during pivoting of the at least one rod with respect to the lateral arms to the active, support position, so as to comprise means for defining the active, support position of the at least one rod. Further, in this embodiment the binding can further comprise means for biasing the at least one rod into the active, support position. Also, the binding can further comprise means for being manually gripped by the skier. The gripping means is attached to the at least one rod to facilitate displacement of the at least one rod into the inactive, retracted position.

In still another embodiment, the support element is displaceable with respect to the ski and comprises a tongue extending transversely with respect to the ski. The tongue is journalled on one of the ski and an element integral with the ski around a substantially vertical axis. In the active, support position the tongue is positioned under the lateral arms to support the lateral arms against pivoting in the direction of the ski. Further, in order to be displaced from the active to the inactive position, the tongue is rotated in a rearward direction around the substantially vertical axis.

In still another embodiment the invention relates to a device for assisting a skier to manually remove a boot from a ski binding. The binding comprises an assembly comprising a jaw, two lateral arms, and a journal. A first ends of the two lateral arms are pivotally attached to the ski around a first transverse axis. The journal pivotally attaches a second end of the two lateral arms to the jaw around a second transverse axis. The jaw is biased against pivoting around the journal. The assembly is adapted to be displaced around the second transverse axis between a retention position, in which the jaw is retained on the ski during skiing, and an emergency release position in which the boot can be disengaged from the ski without substantial effort by the skier. The retention position is higher than the emergency release position. The device to be used with such a binding comprises a support adapted to be displaced from an active support position to an inactive retracted position. In the active support position the support supports the assembly in its retention position and prevents the assembly from being displaced into its emergency release position. In its inactive retracted position the assembly is unsupported by the support, thereby permitting the assembly to be displaced into its emergency release position. In another embodiment the invention comprises this device in combination with the above discussed binding.

In the retention position of the assembly the jaw is adapted to pivot against the bias of an elastic means between a first position and a second position. In the first position the jaw holds a portion of the boot. In the second position the jaw is out of contact with the boot. The support comprises means for permitting the jaw to be displaced between its first and second positions when the support is in its active support position.

The support can comprise a support element slidably attached to the ski and adapted to be slidingly displaced between an active support position in which the support supports the binding, and an inactive, retracted position. Also, the device can further comprise an abutment for limiting the displacement of the support element in the inactive position.

The support can also comprise a rod having a first end attached to the binding, and a second end comprising a roller sliding on the upper surface of the support element. This device can have all of the characteristics described above in the other embodiments. Further, the invention relates to such a device in combination with the binding described above in the other embodiments.

BRIEF DESCRIPTION OF THE DRAWINGS

Other characteristics and advantages of the present invention will become clear from the detailed description which follows and upon reviewing the attached drawings in which:

FIG. 1 shows a side view of the present invention partially in cross-section in which the support is in its active, support position, and the binding is in its boot releasing position;

FIG. 2 illustrates a side view of the present invention partially in cross-section in which the support is in its active, support position, and the binding is in its boot retaining position;

FIG. 3 illustrates a side view partially in cross-section in which the support is in its active, support position, and the binding is manually pivoted from its boot retention position toward its boot releasing position;

FIG. 4 illustrates a side view partially in cross-section in which the support is displaced into its retracted position and in which the binding can be displaced into its boot releasing position;

FIG. 5 illustrates a side view partially broken away of the present invention in which the binding is in its boot retention position and the support is in its active, support position;

FIG. 6 shows a side view of a portion of the binding and the support illustrated in FIG. 5;

FIG. 7 shows a side view of the second embodiment of the present invention in which the support is in its active, support position and the binding has begun to be retracted from its boot retention position to its boot releasing position;

FIG. 8 illustrates a side view of the second embodiment of the present invention in which the support is retracted into its inactive, retracted position, and the binding can be manually displaced into its boot releasing position in the case of an emergency without substantial effort by the skier;

DETAILED DESCRIPTION OF PREFERRED EMBODIMENTS

Figure 1:
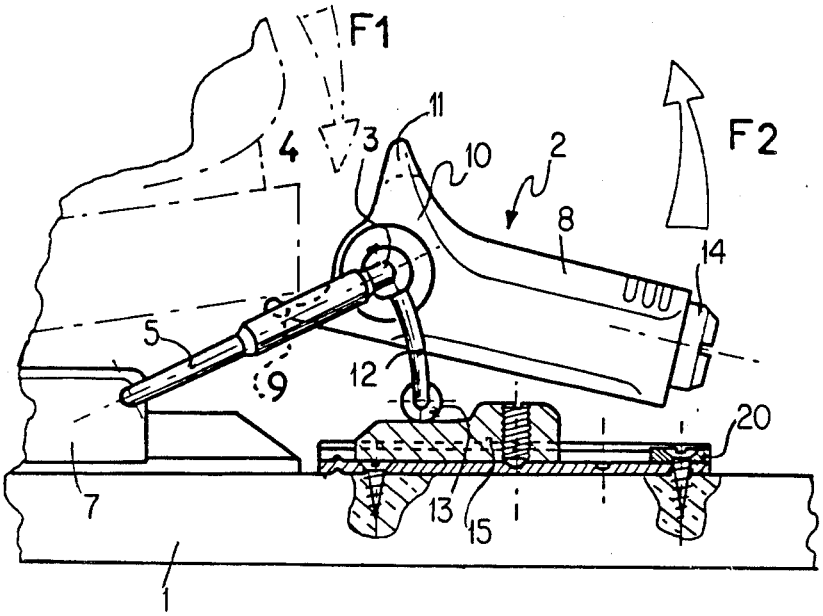
FIGS. 1–4 illustrate a first embodiment of the present invention.

FIGS. 1–10 schematically illustrate the safety binding of the present invention which holds one end of a ski boot. More particularly, the present invention illustrated in FIGS. 1–10 illustrate a safety ski binding which is adapted to hold the heel of a ski boot. This binding has the general structural and functional characteristics of the bindings described in the patents incorporated by reference above to which reference may be made if necessary. Only the elements important for understanding the present invention will be described below in detail.

As illustrated in FIGS. 1–4, the present invention comprises a heel binding 2 which is rotatable around a journal 3 transverse to the longitudinal axis of a ski 1. Heel binding 2 is adapted to attach the rear of heel 4 of the boot to the ski via jaw 10. Binding 2 is attached to ski 1 by two lateral arms or lateral boot straps 5 positioned on either lateral side of the boot and extending from each end of the boot. These arms 5 are pivotally mounted at their forward end to a base element 7 which is positioned under the sole of the boot and on top of ski 1. Lateral arms 5 are adapted to pivot at their forward end around an axis 6 transverse to the longitudinal axis of ski 1 and parallel to the plane of the upper surface of ski 1.

Figure 3:
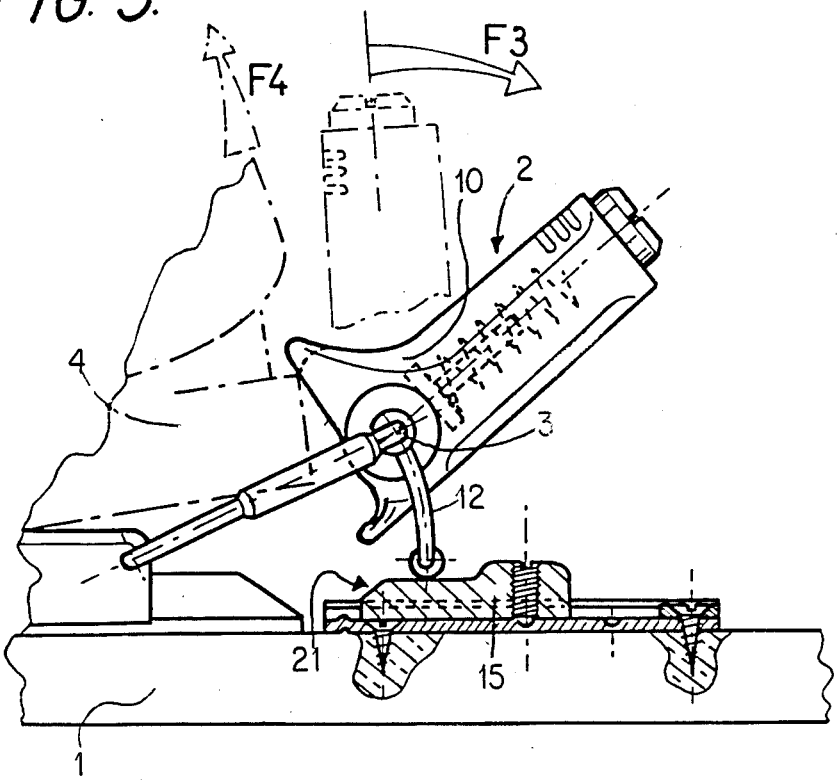

Heel binding 2 comprises a hollow body 8 within which, in a known manner, an elastic element or biasing means is positioned, as illustrated in FIG. 3. This elastic element can be for example, a coil-type spring one end of which rests on small collar 14. Collar 14 is adapted to be screwed into one end of body 8 and adjusts the bias of the spring on the binding. The other end of the spring rests upon journal 3 or on an element cooperating with journal 3. In order to adjust the predetermined bias of the spring on the binding one selects the predetermined amount of bias desired by rotating collar 14 a predetermined amount into body 8.

The elastic element in body 8 biases body 8 against pivoting around journal 3. It is the force generated by the elastic element that provides the retention force holding the boot on the binding during skiing because a portion of body 8 holds the boot. As a result, the bias against pivoting body 8 around journal 3 is substantial and requires substantial effort by the skier to pivot body 8 around journal 3 to release the boot from the ski. This operation is illustrated in FIGS. 1–3, and 5–7 and will be discussed in more detail below. Each of the positions illustrated in FIGS. 1–3 and 5–7 are called a boot retention position of the binding.

Figure 4:
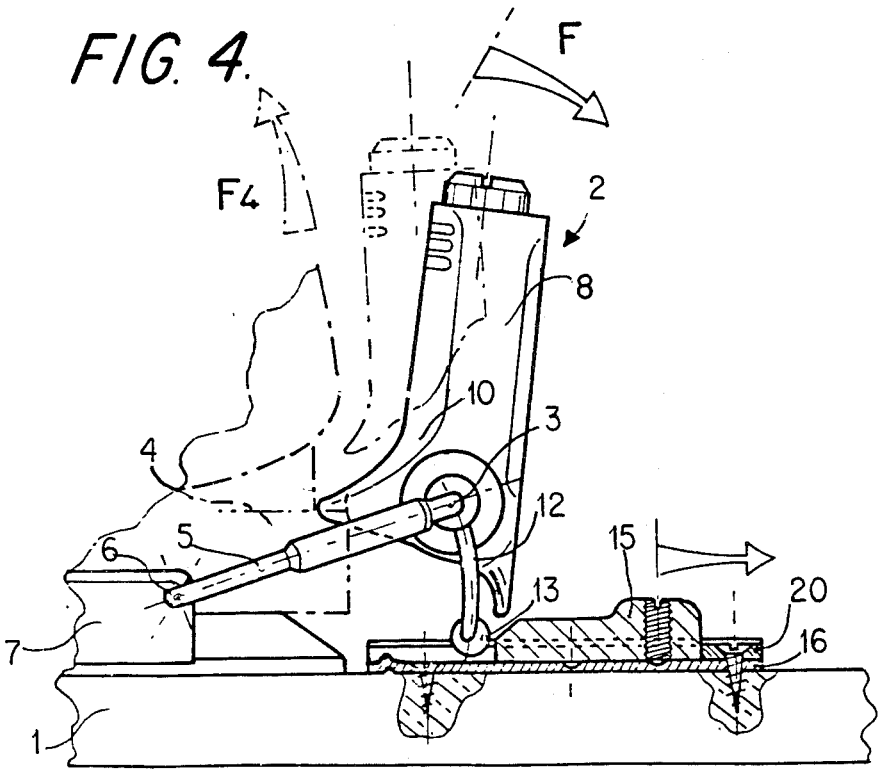
Figure 8:
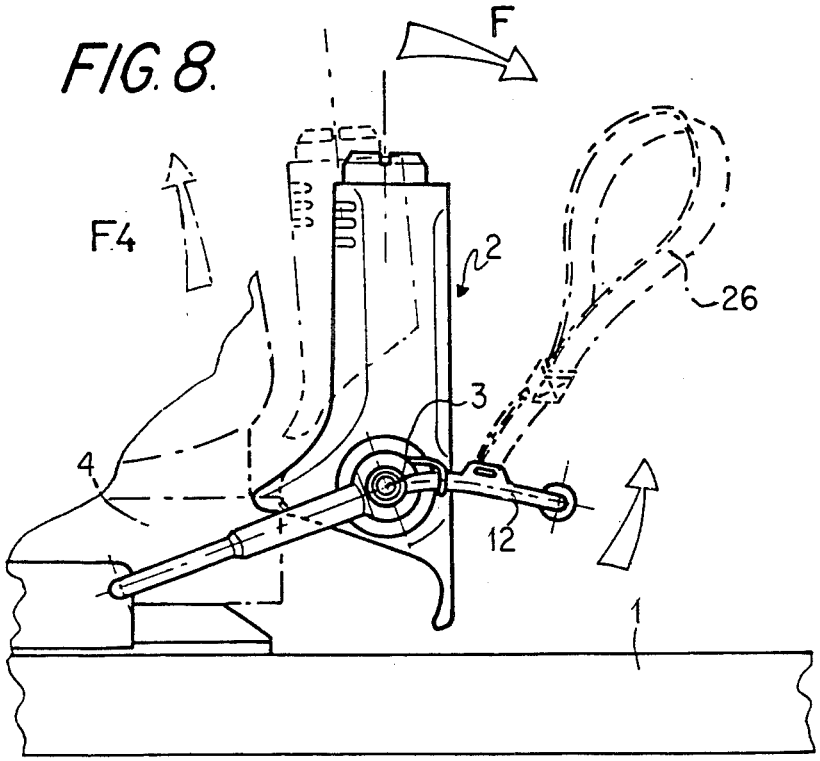

In an emergency it may be desirable for the skier to remove the boot from the ski without substantial effort. The present invention accomplishes this objective by permitting body 8 to pivot not around journal 3, but around axis 6 so that the portion of body 8 holding the boot is displaced downwardly toward said ski and longitudinally away from said boot and away from an associated toe binding to a point at which the boot can be freed from the binding with substantially little or no effort, as is illustrated in FIG. 4. Because the elastic element does not bias body 8 against pivoting around axis 6, this can be accomplished with substantially little or no effort by the skier, as will be described in more detail below. The position of the binding illustrated in FIGS. 4 and 8 is called the emergency release position.

Journal 3 pivotally attaches body 8 with the rear end of lateral arms 5. In addition, the bottom of body 8 comprises a portion forming a retention jaw 10 which is adapted to be supported on the edges of boot 4 by a projection 11. Jaw 10, journal 3, and lateral arms 5 form an assembly which together are adapted to be supported by the retractable support and are adapted to be positioned in the first and second boot retention positions mentioned above.

In addition, body 8 further comprises a tongue 9 which extends from the side of body 8 opposite from projection 1. Tongue 9 extends substantially horizontally and is the forwardmost portion of body 8 when in the boot attaching and boot releasing position as illustrated in FIG. 1. As a result, in order to attach the boot to the binding of the present invention, the heel of the boot presses downwardly upon forwardly extending tongue 9 as illustrated in FIG. 1, thereby pivoting body 8 in the counterclockwise direction from its boot releasing and boot attaching position illustrated in FIG. 1 to the boot retaining position illustrated in FIG. 2.

The operation of heel binding 2 is known to those skilled in the art.

FIGS. 1–4 illustrate a first embodiment of the present invention. In this embodiment the present invention comprises a support for supporting binding 2. More particularly the support supports journal 3, arms 5, and jaw 10 in a boot retention position. In this position a rod 12, which extends downwardly from journal 3, is supported by a retractable support 15 which is in its active position illustrated in FIGS. 1–3. When the support is retracted so that it no longer supports jaw 10, lateral arms 5, and axis 3, the assembly of these elements can be easily displaced downwardly toward the ski into an emergency release position around axis 6 as is illustrated in FIG. 4. During this procedure the assembly primarily pivots around axis 6 and pivots only slightly around journal 3 so that substantially little or no effort is required by the skier. Further, in being displaced from the boot retention position in FIG. 2 to the emergency release position in FIG. 4, jaw 10 is displaced from a position in which it extends over a substantial length of the sole of the boot in FIG. 1 to a position in which jaw 10 is almost tangential to the vertical edge of the sole of the boot, as illustrated in FIG. 4. In this position, the boot can be freed from the binding with substantially little or no effort by the skier. As a result, the present invention makes it possible for binding 2 to be easily displaced from its boot retention position to its emergency boot releasing position without substantial effort by the skier and for the boot to be released from the binding without substantial effort by the skier once binding 2 is in its emergency release position.

In the embodiment illustrated in FIGS. 1–4 this support comprises a rod 12 and sliding support element 15. Rod 12 is integral with lateral arms 5, and rod 12 extends downwardly from arms 5 and journal 3. The bottommost end of rod 12 comprises a roller 13 which rests on the upper surface of support element 15. Support element 15 is slidably attached to ski 1 so that support element 15 slides between an active, support position illustrated in FIGS. 1, 2 and 3, and an inactive, retracted position in FIG. 4. In the active, support position illustrated in FIGS. 1–3, support 15 and rod 12 elevate and support body 8 and the assembly of journal 3, arms 5, and jaw 10 into a first position in which these elements compress the spring and are thus biased by a substantial predetermined amount of force against displacement out of the boot retention position illustrated in FIG. 2.

Figure 2:
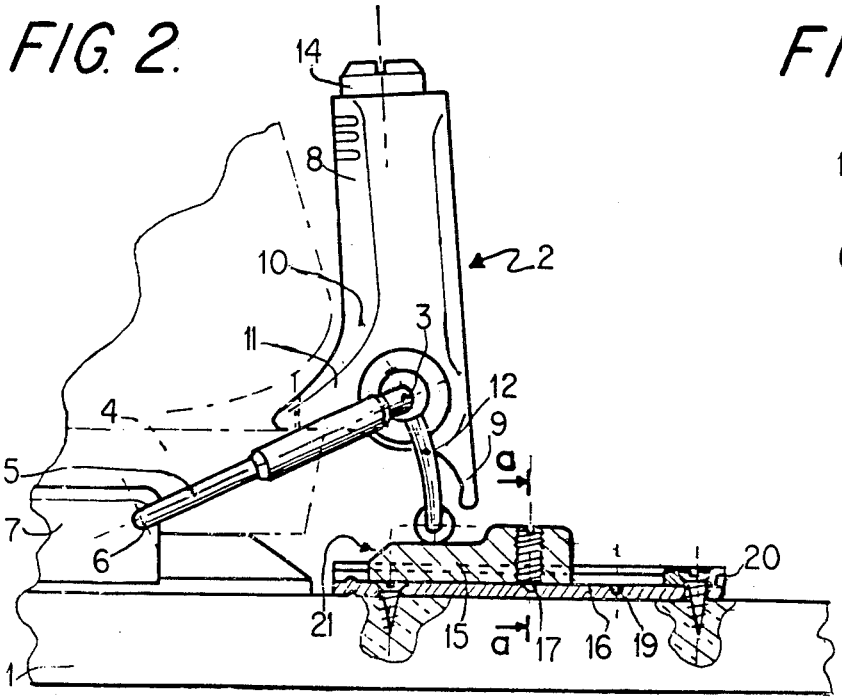

The operation of placing the boot in the binding as illustrated in FIG. 1 occurs in the usual manner. More specifically, the boot is placed in the binding and attached to the ski by displacing the boot in the downward direction along the direction of arrow $F_1$ so that the heel of the boot rests upon tongue 9. The heel of the boot is then pushed downwardly so as to pivot tongue 9 and body 8 in the counterclockwise direction along the direction of arrow $F_2$ so that binding 2 and body 8 then pivot into a latched, boot retention position in which the boot is held on ski 1 by binding 2, as illustrated in FIG. 2.

The normal operation of manually releasing the boot from the ski is illustrated in FIG. 3. This occurs in the normal manner by manually pressing body 8 in the direction of arrow $F_3$ which compresses the elastic apparatus or spring positioned within body 8 and frees heel 4 of the boot which can then be lifted upwardly in the direction of arrow $F_4$. During this process, rod 12 and roller 13 are maintained in positive contact with the upper surface of support element 15. This operation requires a substantial effort by the skier.

In the event of an emergency in which the removal of the boot from the binding must be accomplished without substantial effort by the skier, support element 15 can be retracted without substantial effort by the voluntary action the skier to its inactive, retracted position illustrated in FIG. 4. As a result of retracting support element 15 into its inactive, retracted position, roller 13 will no longer be supported by element 15, as illustrated in FIG. 4.

Figure 2A:
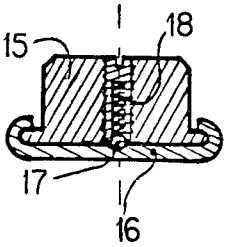
FIG. 2*a* illustrates a partial cross-sectional view taken along line a—a in FIG. 2.

Support element 15 is preferably slidably mounted on a base plate 16 which is attached to ski 1 for example by screws. Furthermore, support element 15 is provided with an apparatus for assuring that element 15 can be easily displaced and maintained in its active, support position and in its inactive, retracted position. This positioning apparatus comprises a ball spring apparatus comprising a ball 17, a spring 18, and spherical recesses 19. This apparatus is illustrated in detail in FIGS. 2*a* and 2. Ball 17 and spring 18 are positioned in a vertical opening in support element 15. Spring 18 biases ball 17 downwardly into contact with one of two spherical recesses 19 positioned on the upper surface of base element 16. One of these spherical recesses 19 is positioned at the active, support position of support element 15, and the other of these spherical recesses 19 is positioned at the inactive, retracted position of support element 15. The bias of spring 18 holds support element 15 in the active and inactive positions in recesses 19 but permits support element 15 to be easily moved with substantially little effort by the skier between the active and inactive positions.

In addition, an abutment 20 is preferably provided to limit the displacement of support element 15 rearwardly beyond its inactive, retracted position so as to avoid the displacement of support element 15 off of the ski, thereby preventing its loss in the snow. Support element 15 can also be provided with a ramp 21 at the forward end of support element 15 to facilitate displacement of roller 13 downwardly in the direction of the ski when support element 15 is retracted from its active position into its inactive position.

As illustrated in FIG. 4, when support element 15 is retracted to its retracted position, binding 2 can easily be displaced downwardly and rearwardly and in the direction of arrow F from its boot retention position to its emergency release position without substantial pivoting around journal 3 and without substantial effort by the skier because the jaw is no longer supported by support 15 and because the bias of the elastic element need not be overcome to any substantially degree. From this position jaw 10 can easily free the sole of the boot without substantial pivoting around journal 3 and, therefore without overcoming the bias of the elastic element to any substantial degree.

Figure 9:
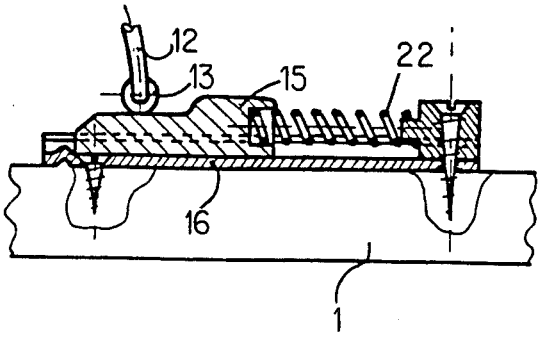
FIG. 9 illustrates a side view partially in cross-section of an alternative embodiment of the support element which can be used with the first embodiment of the present invention.

FIG. 9 illustrates an alternative embodiment in which support element 15 is again slidingly mounted on the ski. However, in this embodiment support element 15 is slidingly mounted on ski 1 against the bias of a spring 22 of low rigidity. Spring 22, however, is of sufficient rigidity to normally assure the retention of support element 15 in its active, support position so that support element 15 supports the binding. Spring 22 is of sufficiently low rigidity that it takes substantially little effort on the part of the skier to displace support element 15 from its active to its inactive position.

It should be noted that in the embodiments described above, support element 15 is slidingly mounted with respect to ski . However, it is within the scope of the present invention to pivotally mount support element 15 on ski 1.

FIGS. 5–8 illustrate a second embodiment of the present invention in which the support means comprises rod 12 alone. As a result, support element 15 is not needed in this embodiment. Further, in the embodiment illustrated in FIGS. 5–8, rod 12 is no longer integral with lateral arms 5, but is rotatably mounted with respect to arms 5 and with respect to jaw 10 on journal 3. In addition, rod 12 carries, in its bottommost end a roller 13 which rests directly on the upper surface of ski 1.

Figure 6A:
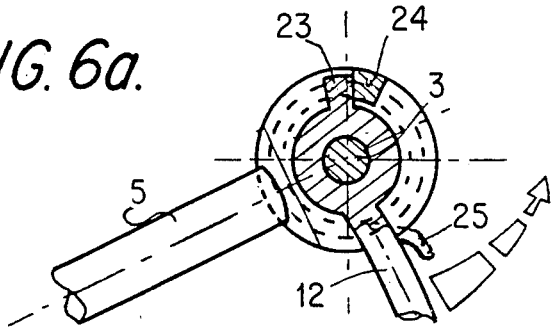
FIG. 6*a* shows a top cross-sectional view taken along line a—a in FIG. 6.
Figure 6:
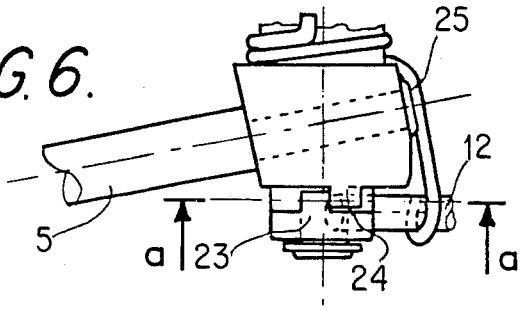
Figure 7:
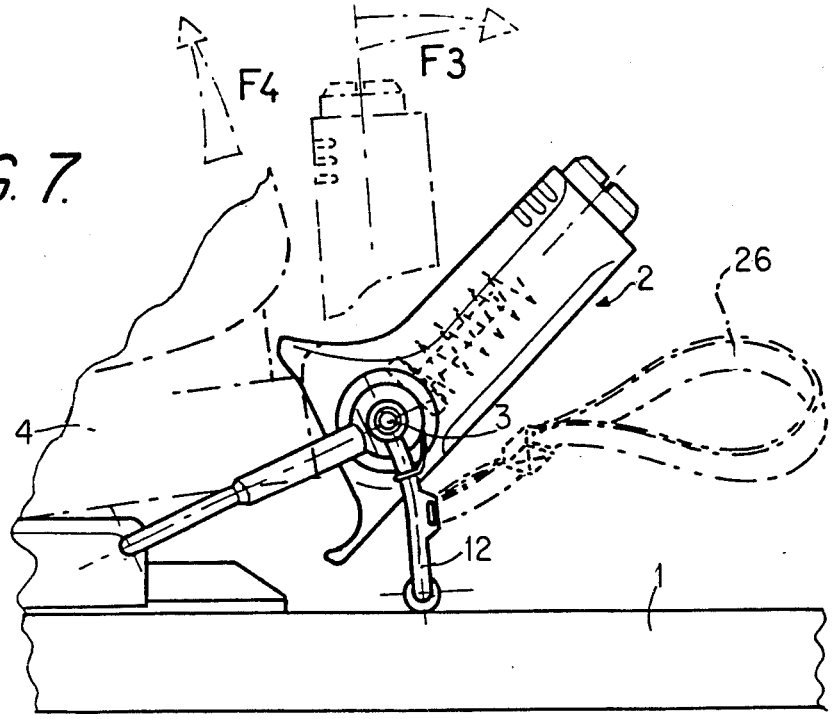

FIGS. 6 and 6*a* illustrate, respectively, a side view and a partial cross-sectional top view of the manner in which rod 12 is mounted on lateral arms 5, journal 3, and jaw assembly 10. As illustrated in FIG. 6*a*, rod 12 comprises an abutment 23 which is adapted to cooperate with abutment 24 integral with arms 5. Abutments 23 and 24 limit the clockwise rotation of rod 12. When abutments 23 and 24 contact each other, rod 12 is in its active, support position, so that these two abutments define the active, support position of rod 12. In addition, a spring apparatus 25 is also provided to pull rod 12 rearwardly into this active support position.

Figure 5:
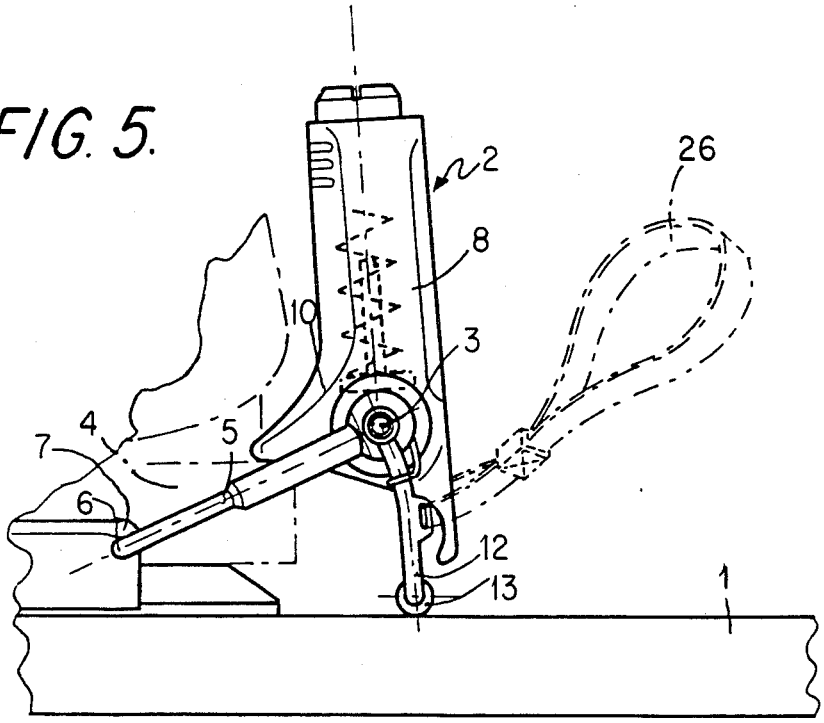
FIGS. 5–8 a second embodiment of the present invention.

In normal use, the apparatus of the present invention illustrated in FIGS. 5–8 operates as in the preceeding embodiments. FIG. 5 shows the binding in its boot retention position, and FIG. 7, which corresponds to FIG. 3 in the previous embodiment, illustrates the normal manual removal of the boot in which support 12 is in its active, support position.

In an emergency, when it is necessary to remove the boot from the binding without substantial effort by the skier, rod 12 is retracted by pivoting rod 12 into its inactive retracted position above and out of contact with ski 1 as illustrated in FIG. 8, thereby permitting the pivoting of the assembly into its emergency release position without substantial effort by the skier. Rod 12 can be pivoted into its retracted position illustrated in FIG. 8 against the weak retention force exerted by spring 25 so that this retraction of rod 12 requires substantially little or no effort by the skier. This retraction of rod 12 into its retracted position is facilitated by providing rod 12 with a gripping apparatus 26 which can be, for example, a buckle or strap which is shown in dashed lines in FIG. 8 and which extends rearwardly from rod 12.

Figure 10:
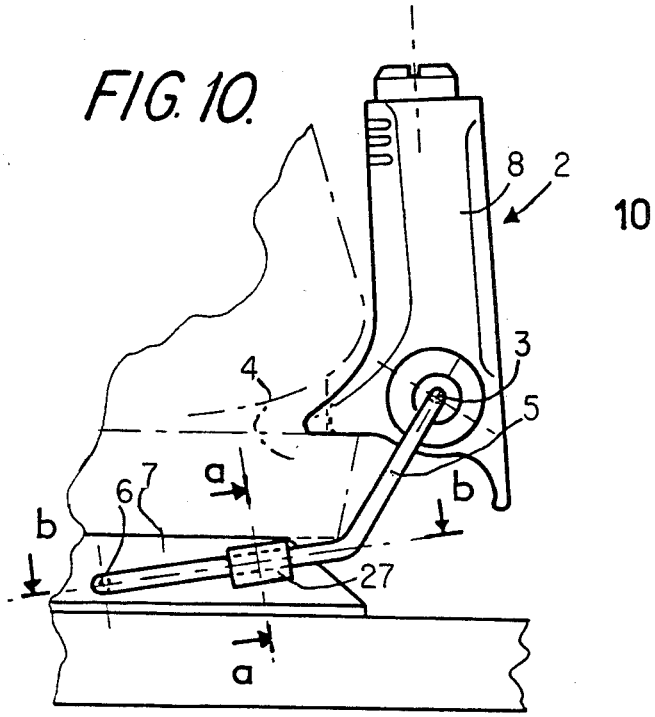
FIG. 10 shows a side view of an alternative embodiment of the support element of the present invention which can be used with the first embodiment of the present invention.
Figure 10A:
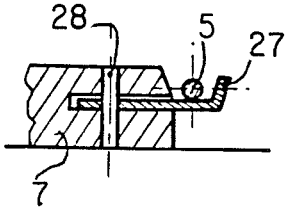
FIG. 10*a* illustrates a cross-sectional of the embodiment illustrated in FIG. 10 view taken along line a13 a of FIG. 10.
Figure 10B:
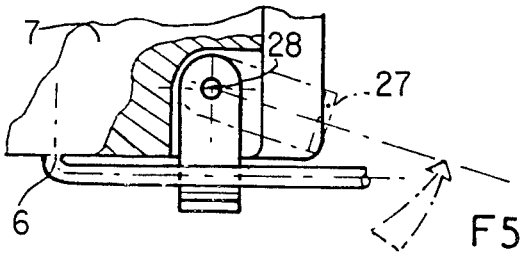
FIG. 10*b* illustrates a cross-sectional view of the embodiment illustrated in FIG. 10 of the present invention taken along line b—b of FIG. 10.

FIGS. 10, 10*a*, and 10*b* illustrate another embodiment of the present invention. In this embodiment lateral arms 5 are preferably angled for constructional and functional reasons. Lateral arms 5 are biased downwardly by their own weight. However, lateral arms 5 are prevented from being pivoted downwardly by their own weight by a support element 27. Support element 27 is in the form of a tongue extending in a direction transverse to the ski. Tongue 27 is pivotally attached to ski 1 around a substantially vertical axis 28 passing through base element 7. Support element 27 is pivotally mounted around this substantially vertical axis on base element 7. In addition, lateral arms 5 are also journalled on base element 7, but around an axis transverse to ski 1.

In the active, support position, support element 27 is positioned under and supports lateral arms 5 and prevents lateral arms 5 from pivoting downwardly in the direction of ski 1 under their own weight. In the case of an emergency, the skier pulls the end of support 27, which is preferably bent, in the direction of arrow $F_5$ in FIG. 10*b*, thereby rotating tongue 27 around axis 28 so as to retract tongue 27 into its inactive, retracted position thereby removing the support from lateral arms 5. As a result, lateral arms 5 will pivot downwardly towards the ski. As a result, binding 2 can be easily pivoted without substantial effort from its boot retention position to a boot releasing position. Furthermore, this pivoting of support element 27 requires a little or no substantial effort by the skier.

Although the invention has been described with respect to particular means, methods and embodiments, it should be understood that the present invention is not limited to the particulars disclosed but extends to all equivalents within the scope of the claims.

What is claimed is:

1. A safety binding for retaining a boot on a ski, wherein said binding comprises:

(a) a jaw for retaining said boot in a given position relative to said ski by means of said binding by applying a force against said boot by means of said jaw and against said ski;

(b) means for manually releasing said boot from said jaw; and (c) means for permitting said boot to be disengaged from said jaw including a support element adapted to be displaceable with respect to said ski between an active support position in which said support element supports said jaw and prevents said jaw from movement toward said ski away from said given position, and an inactive retracted position in which said jaw is unsupported by said support element thereby permitting said jaw to move toward said ski thereby permitting said boot to be disengaged from said jaw.

2. The binding defined by claim 1, wherein said jaw is adapted to be pivotally mounted on said ski around an axis transverse to said ski, wherein said support means limits the pivoting of said jaw toward said ski.

3. The binding defined by claim 2 further comprising:

(c) two lateral arms each having first and second ends, wherein said first ends of said lateral arms are pivotally attached to said ski around an axis transverse to said ski, wherein said second ends of said lateral arms are attached to said jaw.

4. The binding defined by claim 3 further comprising a base element positioned under the sole of said boot and on said ski, wherein said first ends of said two lateral arms are pivotally attached to said base element.

5. The binding defined by claim 3 wherein said jaw is pivotally attached to said second ends of said lateral arms.

6. The binding defined by claim 5 further comprising:

(d) means for elastically biasing said jaw into a position in which said jaw retains said boot on said ski; and (e) means for pivotally attaching said jaw to said second end of said lateral arms, wherein said attaching means, said jaw, and said lateral arms together comprises an assembly, wherein said support means comprises means for normally limiting the pivoting of said assembly toward said ski.

7. The binding defined by claim 3 wherein said support element comprises an upper surface, wherein said support means further comprises:

(ii) at least one rod, integral with said lateral arms, wherein one end of said rod contacts said upper surface of said support element.

8. The binding defined by claim 7 wherein said one end of said at least one rod comprises a roller which contacts said upper surface of said support element.

9. The binding defined by claim 8 wherein said at least one rod extends downwardly from said lateral arms to said support element.

10. The binding defined by claim 9 wherein said support element further comprises a ramp positioned at the forward end of said support element for facilitating the displacement of said roller in the direction of said ski when said support element is displaced into said inactive position.

11. The binding defined by claim 9 wherein said jaw is adapted to be positioned in a retention position in which said jaw holds said boot on said ski, and in a non-retention position in which said jaw releases said boot from said ski and in which said jaw permits said boot to be attached to said binding, wherein said binding further comprises a body comprising said jaw and a tongue, wherein said tongue extends forwardly and generally horizontally when said jaw is in said non-retention position so as to comprise means for pivoting said jaw from said non-retention position to said retention position in response to downward movement of said boot on said tongue.

12. The binding defined by claim 3 wherein said assembly pivots downwardly toward said ski around said transverse axis around which said first ends of said lateral arms are pivotally attached to said ski in response to retraction of said support element into said inactive retracted position.

13. The binding defined by claim 1 further comprising: an abutment for limiting the displacement of said support element beyond said inactive position.

14. The binding defined by claim 1 wherein said support element is slidably attached to said ski so as to slide in the direction of the longitudinal axis of said ski.

15. The binding defined by claim 14 wherein said support element has an opening therein, wherein said binding further comprises:

(f) means for positioning said support element on said ski at said active and inactive positions, wherein said positioning means comprises:

(i) a base plate attached to said ski, wherein said support element is positioned on top of said base plate to slide thereon, wherein said base plate comprises a top surface having two spaced apart recesses therein, wherein the position of each recess corresponds to a different one of said active and inactive positions of said support element; and (ii) a ball spring positioned in said opening in said support element, wherein the bottom end of said ball spring is adapted to engage said recesses in said base plate.

16. The binding defined by claim 1 further comprising means for elastically biasing said support element against displacement between said active and inactive positions.

17. The binding defined by claim 1 wherein said support element comprises:

at least one rod, pivotally attached to said lateral arms around an axis transverse to said ski and movable with respect to said ski, wherein one end of said rod is adapted to normally contact one of the following: the upper surface of said ski and the upper surface of an element integral with said ski.

18. The binding defined by claim 17 wherein said at least one rod is adapted to be displaced with respect to said ski between an active support position in which said at least one rod supports said assembly by said contact between said one end of said rod and one of said upper surface of said ski and the upper surface of an element integral with said ski so as to prevent said assembly from pivoting toward said ski, and an inactive retracted position in which said assembly is unsupported by said at least one rod so as to permit said assembly to pivot toward said ski, wherein in said inactive position said at least one rod is positioned out of contact with one of said upper surface of said ski and said upper surface of an element integral with said ski.

19. The binding defined by claim 18 wherein said at least one rod further comprises a roller positioned at said one end of said at least one rod for contacting one of said upper surface of said ski and said element integral with said ski.

20. The binding defined in claim 19 wherein said lateral arms comprise a first abutment integral therewith, wherein said at least one rod comprises a second abutment, wherein said first and second abutments are adapted to contact each other during pivoting of said at least one rod with respect to said lateral arms to said active, support position so as to comprise means for defining said active, support position of said at least one rod.

21. The binding defined by claim 20 further comprising means for biasing said at least one rod into said active, support position.

22. The binding defined by claim 21 further comprising means for being manually gripped by said skier wherein said gripping means is attached to said at least one rod to facilitate displacement of said at least one rod into said inactive retracted position.

23. The binding defined by claim 1 wherein said support element is displaceable with respect to said ski and comprises a tongue extending transversely to said ski, wherein said tongue is journalled on one of the said ski and an element integral with said ski around a substantially vertical axis, wherein in said active support position said tongue is positioned under said lateral arms to support said lateral arms against pivoting in the direction of said ski, wherein in order to be displaced from said active to said inactive, position said tongue is rotated in the rearward direction around said vertical axis.

24. The binding defined by claim 1 wherein, in said inactive retracted position of said jaw, in which said jaw is unsupported by said support element, said jaw is additionally permitted to move longitudinally away from said boot.

25. A device for assisting a skier to manually remove a bottom from a ski binding assembly attachable to a ski, said ski binding assembly comprising a jaw, two lateral arms, and a journal, wherein a first end of said two lateral arms is pivotally attached to said ski around a first transverse axis, wherein said journal pivotally attaches a second end of said two lateral arms to said jaw around a second transverse axis, wherein said jaw is biased against pivoting around said journal, wherein said binding assembly is adapted to be displaced around said second transverse axis between a retention position, in which said jaw retains said boot on said ski during skiing, a normal release position, and an emergency release position in which said boot can be disengaged from said ski without substantial effort by the skier, wherein said retention position is spaced farther from said ski than said emergency release position, wherein said device comprises:

a support member adapted to be manually displaced from an active support position to an inactive retracted position, wherein in said active support position said support member supports said binding assembly in its retention position and prevents said binding assembly from being displaced into said emergency release position, wherein in said inactive retracted position said binding assembly is unsupported by said support member, thereby permitting said binding assembly to be displaced into said emergency release position.

26. The device defined by claim 25 in combination with said binding.

27. The device defined by claim 25 wherein in said retention position of said assembly said jaw is adapted to pivot against the bias of an elastic means between a first position and a second position, wherein in said first position said jaw holds a portion of said boot, wherein in said second position said jaw is out of contact with said boot, wherein said support comprises means for permitting said jaw to be displaced between its first and second positions when said support is in its active support position.

28. The device defined by claim 25 wherein said support comprises a support element slidably attached to said ski and adapted to be slidingly displaced between its active support position and its inactive, retracted position.

29. The device defined by claim 28 further comprising an abutment for limiting the displacement of said support element in said inactive position.

30. The device defined by claim 28 wherein said support further comprises a rod having a first end attached to said binding and a second end comprising a roller sliding on the upper surface of said support element.

31. The device defined by claim 30 wherein said support element comprises a ramp at one end of said support element for facilitating displacement of said roller in the direction of said ski when said support element is displaced into said inactive retracted position.

32. The device defined by claim 30 further comprising means for positioning said support element on said ski at said active and inactive positions, wherein said positioning means comprises:

(i) a base plate attached to said ski, wherein said support element is slidingly positioned on top of said base plate, wherein said base plate comprises a top surface having two spaced apart recesses therein, wherein the position of each recess corresponds to a different one of said active and inactive positions of said support element; and (ii) a ball spring positioned in said opening in said support element, wherein the bottom end of said ball spring is adapted to engage said recesses in said base plate.

33. The device defined by claim 30 wherein said support can be displaced between its active and inactive positions without substantial effort by the skier, and wherein said assembly can be displaced from its retention position to its emergency release position without substantial effort by the skier.

34. The device defined by claim 33 wherein said one end of said rod is integral with said lateral arms.

35. The device defined by claim 34 in combination with said binding.

36. The device defined by claim 25 wherein said support is slidably attached to said ski, wherein said support further comprises means for biasing said support into said active, support position.

37. The device defined by claim 25 wherein said support comprises an element pivotally attached to said binding and adapted to pivot between an active support position in which said element supports said binding in said retention position and said inactive, retracted position, wherein said element contacts the upper surface of said ski in said active support position.

38. The device defined by claim 37 wherein said element comprises a rod having a roller at one end for contacting said ski in said active support position.

39. The device defined by claim 38 further comprising means for limiting the pivoting of said rod in said active support position.

40. The device defined by claim 38 wherein said binding comprises a first abutment, wherein said rod comprises a second abutment, wherein said first and second abutments are so positioned so as to contact each other during pivoting of said rod to said active, support position so that said first and second abutments comprise means for defining said active, support position of said support.

41. The device defined by claim 38 wherein said rod is pivotally attached to said journal.

42. The device defined by claim 41 in combination with said binding.

43. The device defined by claim 38 further comprising a strap extending rearward from said rod and comprising means for being manually gripped by the skier to pivot said rod from said active support position to said inactive, retracted position.

44. The device defined by claim 25 wherein said support comprises a tongue pivotally mounted around a vertical axis on said ski, wherein in said active support position said tongue is positioned under and contacts said lateral arms.

45. A safety binding for retaining a boot on a ski, wherein said binding comprises:

(a) a jaw for retaining said boot; and

UNITED STATES PATENT AND TRADEMARK OFFICE

CERTIFICATE OF CORRECTION

PATENT NO. : 4,813,719

DATED : March 21, 1989

INVENTOR(S) : Jean-Pierre DIMIER

It is certified that error appears in the above-identified patent and that said Letters Patent is hereby corrected as shown below:

At column 2, line 26, change "end" to ---ends--- after "first".

At column 2, line 37 change, "end" to ---ends--- after "second".

At column 5, line 34 insert ---illustrate--- after "5-8".

At column 5, line 64 change "a13a" to ---a-a---.

At column 5, line 63, insert ---view--- before "of".

At column 5, line 64 delete "view" after "10".

At column 8, line 29 insert ---of--- before "the".

At column 9, line 6, change "substantially" to ---substantial---.

Signed and Sealed this

Sixteenth Day of July, 1991

*Attest:*

*Attesting Officer*

HARRY F. MANBECK, JR.

*Commissioner of Patents and Trademarks*